US011576453B2

(12) United States Patent
Sunseri et al.

(10) Patent No.: US 11,576,453 B2
(45) Date of Patent: Feb. 14, 2023

(54) HEADWEAR BRIM

(71) Applicants: Donald Kelly Sunseri, Gilroy, CA (US); Daniel Kevin Sunseri, Gilroy, CA (US)

(72) Inventors: Donald Kelly Sunseri, Gilroy, CA (US); Daniel Kevin Sunseri, Gilroy, CA (US)

(73) Assignee: Innovations 152 LLC, Gilroy, CA (US)

( * ) Notice: Subject to any disclaimer, the term of this patent is extended or adjusted under 35 U.S.C. 154(b) by 6 days.

(21) Appl. No.: 16/948,776

(22) Filed: Sep. 30, 2020

(65) Prior Publication Data

US 2021/0100307 A1 Apr. 8, 2021

Related U.S. Application Data

(60) Provisional application No. 62/910,237, filed on Oct. 3, 2019.

(51) Int. Cl.

| | |
|---|---|
| ***A42B 1/22*** | (2006.01) |
| ***A42B 1/201*** | (2021.01) |
| ***A42B 1/205*** | (2021.01) |
| ***A42B 1/02*** | (2006.01) |
| ***A42B 1/18*** | (2006.01) |

(52) U.S. Cl.

CPC ..... *A42B 1/205* (2013.01); *A42B 1/02* (2013.01); *A42B 1/18* (2013.01); *A42B 1/201* (2013.01); *A42B 1/22* (2013.01)

(58) Field of Classification Search

CPC .. A42B 1/205; A42B 1/02; A42B 1/18; A42B 1/201; A42B 1/22; A42B 1/0186; A42C 5/04

USPC ..... 2/171.03, 209.5, 175.1, 175.5, 195.1, 2/195.6, 171.2, 171.3, 171.4

See application file for complete search history.

(56) References Cited

U.S. PATENT DOCUMENTS

| | | | | | |
|---|---|---|---|---|---|
| 588,241 | A * | 8/1897 | Ray | A42C 5/04 | 2/182.6 |
| 1,368,864 | A * | 2/1921 | Turner | A42B 1/18 | 2/175.6 |
| 1,587,681 | A * | 6/1926 | Schumacher | A42B 1/18 | 2/175.6 |
| 2,960,697 | A * | 11/1960 | Segan | A42C 5/04 | 2/7 |
| 5,091,995 | A | 3/1992 | Oates | | |
| 5,323,491 | A | 6/1994 | Barrett, Jr. | | |
| 5,406,645 | A * | 4/1995 | Lin | A42B 1/0182 | 2/10 |
| 5,548,846 | A | 8/1996 | Bianchetti | | |
| 5,592,696 | A * | 1/1997 | Oliver | A42B 1/02 | 2/175.3 |
| 5,655,225 | A | 8/1997 | Mathers | | |
| 5,669,074 | A | 9/1997 | Newman, Jr. | | |
| 5,669,075 | A | 9/1997 | Weeks | | |

(Continued)

*Primary Examiner* — Clinton T Ostrup
*Assistant Examiner* — Akwokwo Olabisi Redhead
(74) *Attorney, Agent, or Firm* — Dunlap Bennett & Ludwig, PLLC

(57) ABSTRACT

A 360-degree brim from improving the sun protection of a separate headwear. The 360-degree brim may have a pull cord for selectively adjusting the fit of its head opening. The 360-degree brim may have fold lines for moving the 360-degree brim between a plurality of successively smaller folded conditions for storage and ease of access.

7 Claims, 4 Drawing Sheets

(56) References Cited

U.S. PATENT DOCUMENTS

| | | | | |
|---|---|---|---|---|
| 5,802,617 | A * | 9/1998 | Boden | A42B 1/22 2/175.1 |
| 5,862,520 | A | 1/1999 | Wyant | |
| 6,029,278 | A | 2/2000 | Lopez | |
| 6,163,886 | A | 12/2000 | Carter | |
| 6,381,750 | B1 | 5/2002 | Mangan | |
| 6,484,323 | B1 * | 11/2002 | Pu | A42B 1/201 2/10 |
| 7,310,829 | B1 | 12/2007 | Engel-Wilson | |
| 8,375,469 | B2 * | 2/2013 | Duwyn-Zylstra | A42B 1/206 2/175.1 |
| 9,402,432 | B2 | 8/2016 | Dean | |
| 9,743,699 | B2 | 8/2017 | Peterson | |
| 10,342,276 | B2 | 7/2019 | Buri | |
| 10,555,574 | B2 | 2/2020 | Woo | |
| 2009/0055995 | A1 * | 3/2009 | Garza | A42B 1/006 2/209.11 |
| 2014/0331384 | A1 * | 11/2014 | Terada | A42B 1/201 2/175.5 |
| 2015/0113707 | A1 * | 4/2015 | Tsai | A42B 1/206 2/209.13 |
| 2016/0021960 | A1 * | 1/2016 | Lacy | A42B 1/201 2/175.1 |
| 2016/0073720 | A1 | 3/2016 | Niedrich | |
| 2017/0071278 | A1 | 3/2017 | Schulz et al. | |
| 2018/0027911 | A1 | 2/2018 | Weiler et al. | |
| 2019/0166940 | A1 | 6/2019 | Lybarger | |
| 2021/0259345 | A1 * | 8/2021 | Michaels | A42B 1/22 |

* cited by examiner

HEADWEAR BRIM

CROSS-REFERENCE TO RELATED APPLICATION

This application claims the benefit of priority of U.S. provisional application No. 62/910,237, filed 3 Oct. 2019, the contents of which are herein incorporated by reference.

BACKGROUND OF THE INVENTION

The present invention relates to headwear and, more particularly, a headwear accessory providing a 360-degree brim affording sunshade and ultraviolet (UV) protection about a wearer's head and neck.

Many very popular headwear designs, such as the baseball cap, leaves the wearer exposed to damaging UV and high temperatures due to the insufficient breadth of the headwear's brim. Specifically, the common baseball cap currently provides approximately 90-degrees of brim protection from UV/heat sun exposure leaving the wearer's neck, ears and a portion of their face unprotected from the harmful UV and heat exposure due to sunlight.

As can be seen, there is a need for a headwear accessory to provide 360-degrees of sunshade and UV protection about a wearer's head and neck, even if their primary headwear does not. The present invention can be added and removed at the wearer's discretion. In other words, the present invention enables the wearer to convert the "baseball cap" into a hat with 360-degree brim coverage in seconds, providing increased protection from UV and high temperature sun exposure to the wearer's head, ears, face and neck.

The present invention is foldable between one of three folded conditions for easy storage and readily accessibility.

Though the 360-degree supplemental brim embodied by the present invention will work in conjunction with the baseball cap and other headwear, the present invention can be used by itself and still provide many of the same benefits and advantages.

SUMMARY OF THE INVENTION

In one aspect of the present invention, headwear brim includes the following: an annulus substrate defining a head opening; a plurality of fold lines radially extend along the annulus substrate; a UV-protective material sandwiching the annulus substrate and a cord along a circumference of the head opening; and a portion of the cord protruding from the UV-protective material in such a way that the cord moves between a slack state and one of a plurality of tightened states.

In another aspect of the present invention, the headwear brim includes the following: an annulus substrate defining a head opening; four equally spaced apart fold lines radially extending along the annulus substrate; a UV-protective material sandwiching the annulus substrate and a cord along a circumference of the head opening, wherein the UV-protective material 12 has a circumferentially spaced apart stitching pattern, wherein the sandwiched cord occupies a cord channel defined by the circumference of the head opening and the UV-protective material; a portion of the cord protruding from the UV-protective material in such a way that the cord moves between a slack state and one of a plurality of tightened states; and a cord lock operatively associating with said portion to move each tightened state between an unlocked condition and a locked condition.

In yet another aspect of the present invention, a method of increasing a sun-protection efficacy of a baseball cap, the method includes donning the above-mentioned headwear brim over said baseball cap.

These and other features, aspects and advantages of the present invention will become better understood with reference to the following drawings, description and claims.

DETAILED DESCRIPTION OF THE INVENTION

Figure 1:
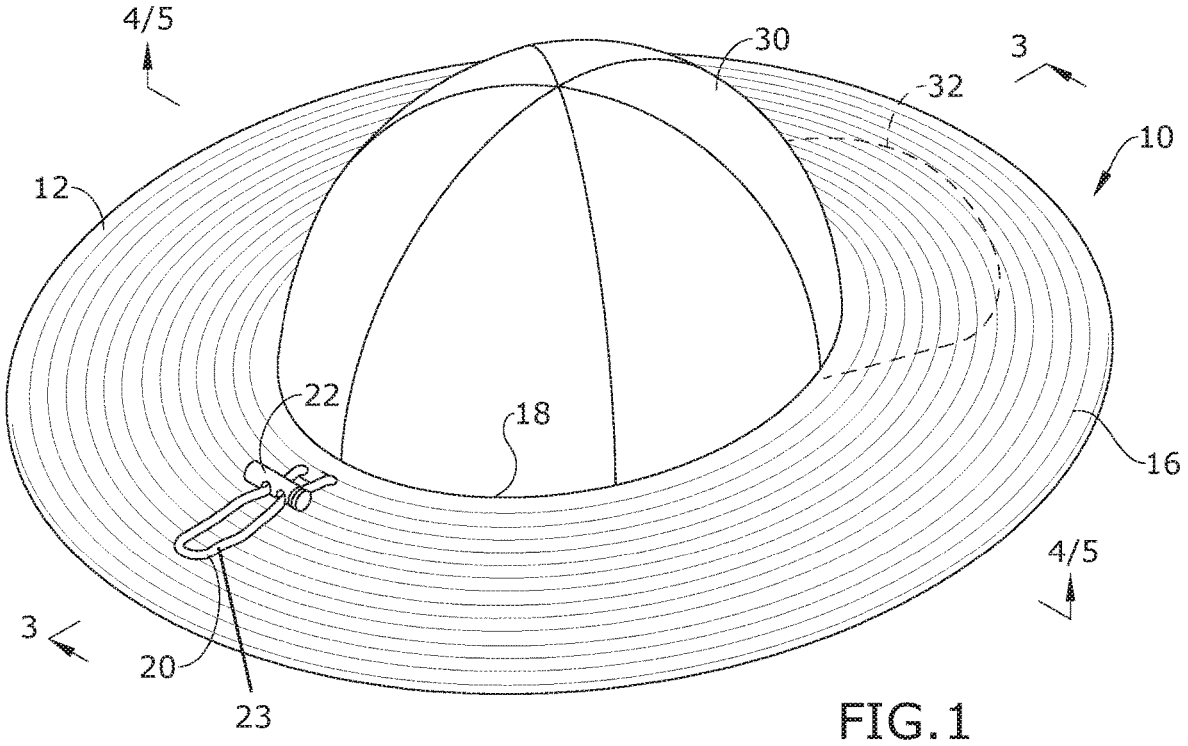
FIG. 1 is a top perspective view of an exemplary embodiment of the present invention.
Figure 2:
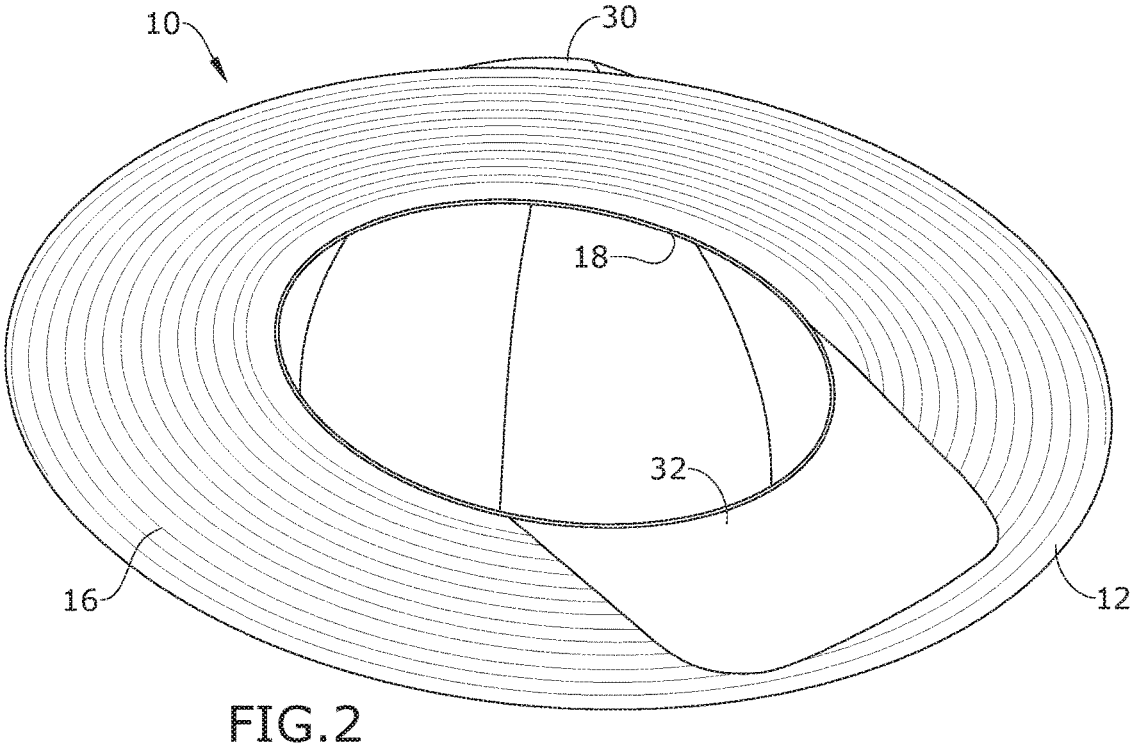
FIG. 2 is a bottom perspective view of an exemplary embodiment of the present invention.
Figure 3:
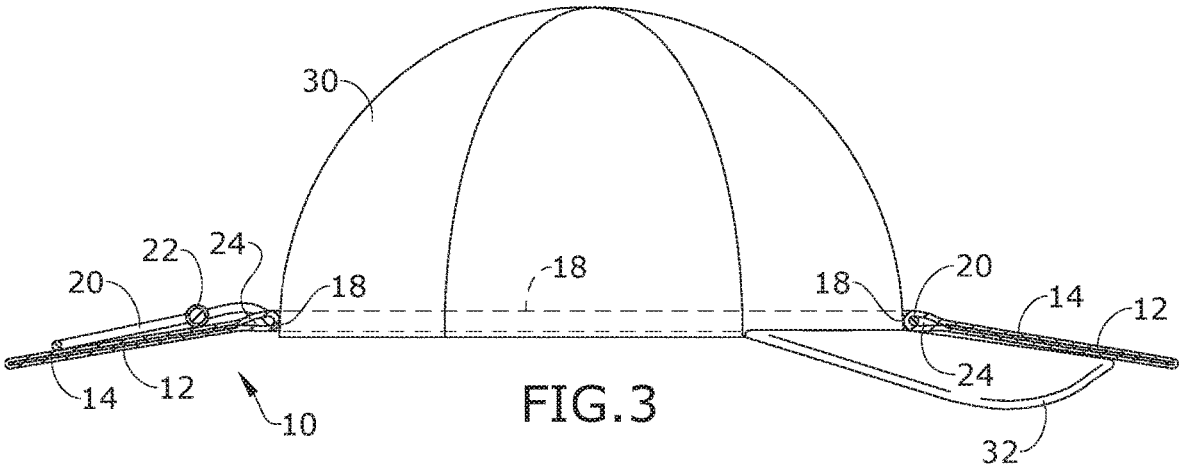
FIG. 3 is a section elevation view of an exemplary embodiment of the present invention, taken along line 3-3 in FIG. 1.
Figure 4:
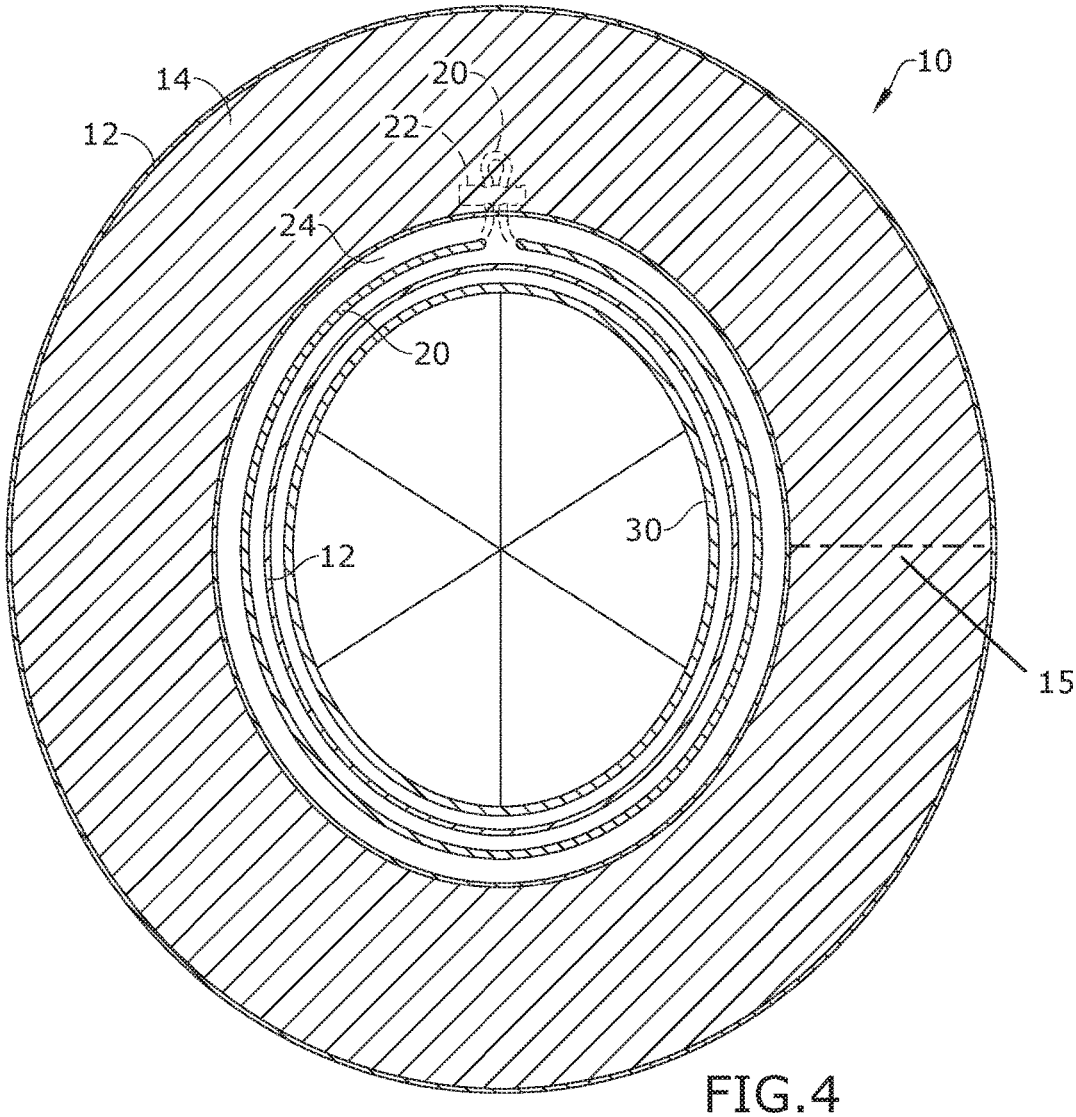
FIG. 4 is a section elevation view of an exemplary embodiment of the present invention, taken along line 4-4 in FIG. 1, with headwear brim 10 shown as flat and with cord 20 loosened to open inner ring 18 to a widest position.
Figure 5:
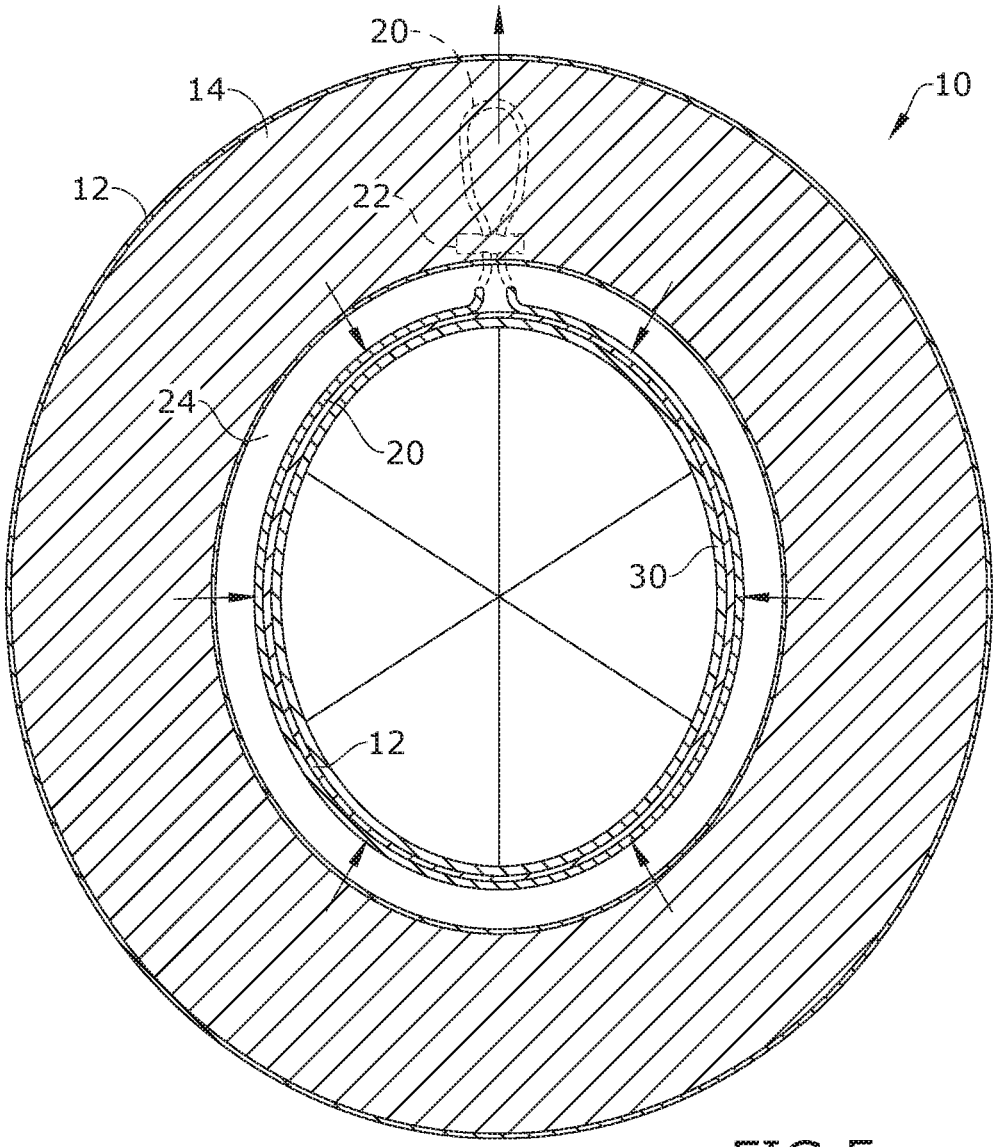
FIG. 5 is a section elevation view of an exemplary embodiment of the present invention, taken along line 5-5 in FIG. 1, illustrating the pulling cord 20 moved to a tightened state, as indicated by the arrows, thereby reducing the circumference of the head opening 18 onto a cap 30 and/or the wearer's head.
Figure 6:
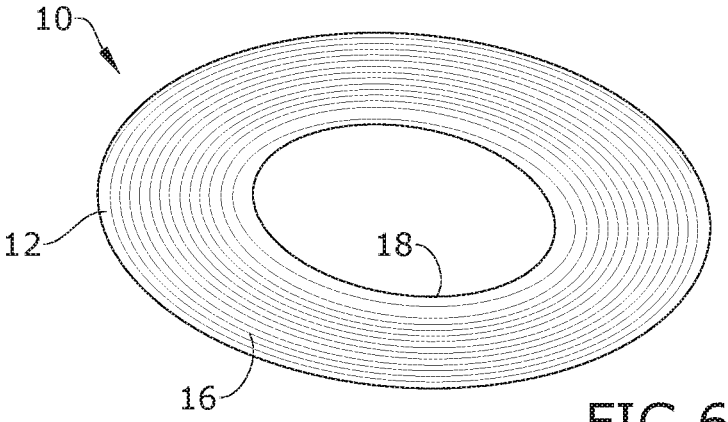
FIG. 6 is a bottom perspective view of an exemplary embodiment of the present invention.
Figure 7:
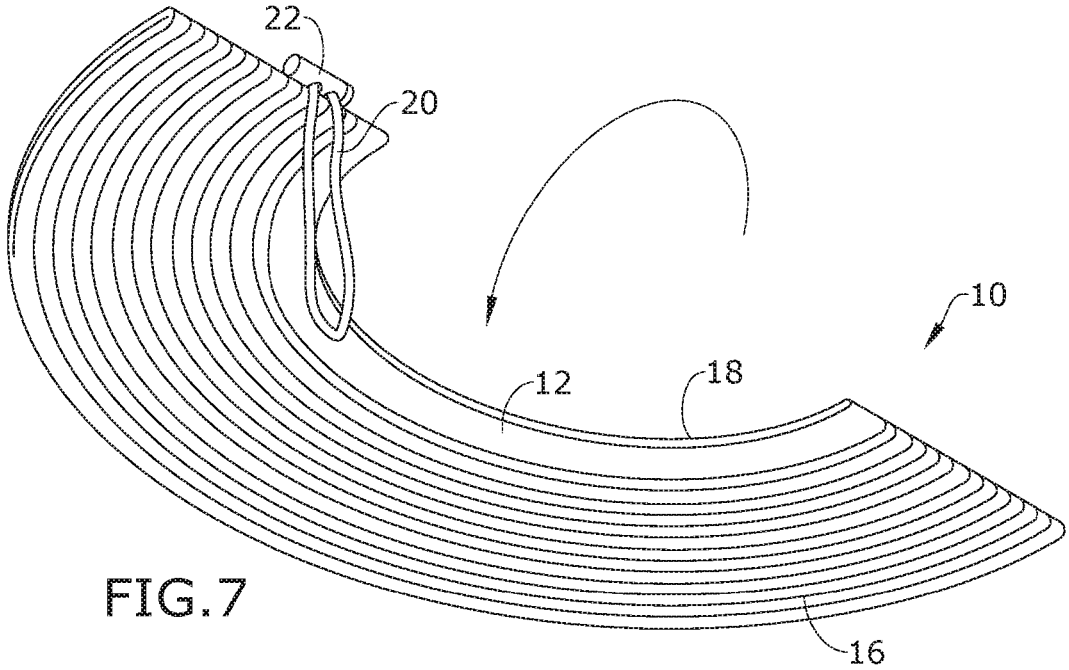
FIG. 7 is a bottom perspective view of an exemplary embodiment of the present invention, illustrating a first folded condition.
Figure 8:
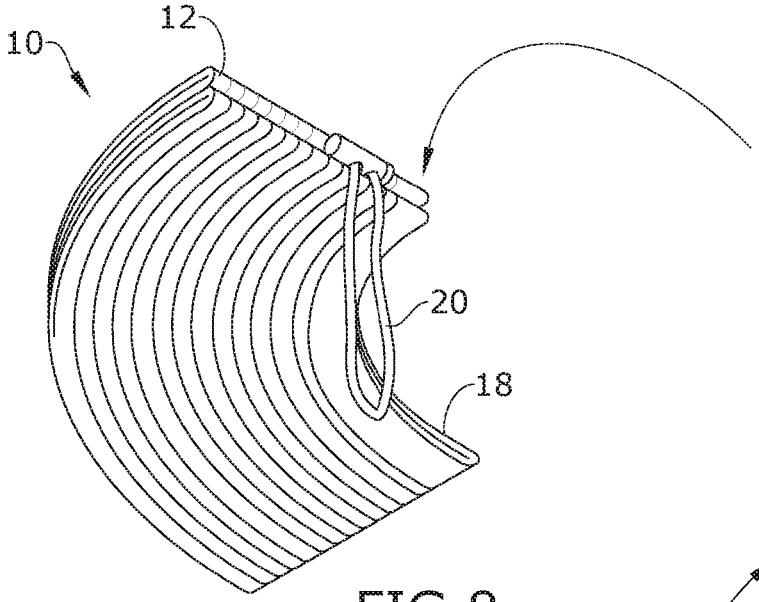
FIG. 8 is a bottom perspective view of an exemplary embodiment of the present invention, illustrating a first folded condition.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a 360-degree brim from improving the sun protection of a separate headwear. The 360-degree brim may have a pull cord for selectively adjusting the fit of its head opening. The 360-degree brim may have fold lines for moving the 360-degree brim between a plurality of successively smaller folded conditions for storage and ease of access.

Referring now to FIGS. 1 through 9, the present invention may include a headwear brim 10 defining a head opening 18. The brim 10 provide an exterior UV protective material 12 sandwiching a foldable substrate 14.

Figure 9:
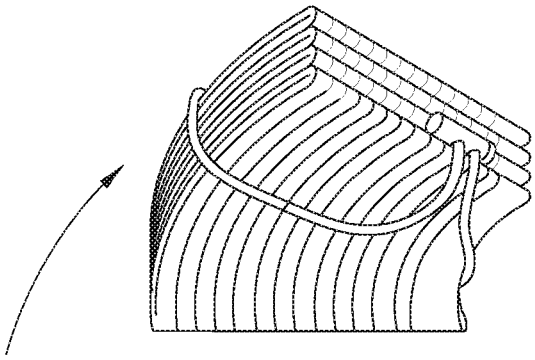
FIG. 9 is a bottom perspective view of an exemplary embodiment of the present invention, illustrating a final folded condition.

The sturdy but foldable substrate 14 may provide fold lines 15 that enable the foldable substrate 14 to move between a first folded condition (FIG. 7), a second folded condition (FIG. 8) and a third folded condition (FIG. 9). The folded conditions may be successive halves of the previous condition. Note, though FIG. 4 only shows one fold line 15 it should be understood that a plurality of the fold lines 15 may be formed radially along the foldable substrate 14, possibly spaced apart every 90-degrees about a center of the head opening 18.

The UV protective material 12 may be a synthetic fabric with a spaced apart circumferential stitching pattern.

Just inward of the head opening 18 may be cord channel 24 disposed between the exterior UV protective material 12 and circumferentially contiguous with and/or circumscribing the head opening 18. A cord 20 may occupy the cord channel 24 and protrude therefrom in the form of a protrusion 23. The protrusion 23 may be loop. A cord lock 22 may operatively associated with the protrusion 23 so that the cord 20 can move between a slack state and one of a plurality of tightened states, which in turn can be locked by the cord lock 22, whereby the circumference of the head opening 18 can be selectively adjusted to cinch along a head of a wearer and/or a headwear the wearer is wearing.

A method of using the present invention may include the following. The headwear brim 10 disclosed above may be provided. The headwear brim 10 may be placed over another headwear with an insufficient brim 32, such as a baseball cap, and adjusted to fit the wearer by engaging the cord 20, thereby providing a 360-degree brim of UV protection, shading and cooling for the wearer's face, head and neck area. It should be understood, of course, that there the wearer need not be wearing another headwear 30 and can use the headwear brim 10 directly on their head.

Subsequent use, the headwear brim 10 may be folded along the fold lines 25 between one of three folded conditions for convenient storage and ease of access.

It should be understood, of course, that the foregoing relates to exemplary embodiments of the invention and that modifications may be made without departing from the spirit and scope of the invention as set forth in the following claims.

What is claimed is:

1. A headwear brim comprising:

an annulus substrate defining an inner circumference;

a plurality of fold lines integrated into and radially extending along the annulus substrate, wherein each fold line ends between the inner circumference an outer periphery of the annulus subtrate;

a UV-protective material sandwiching the annulus substrate;

the UV-protective material defining a cord channel along the inner circumference, and wherein the inner circumference defines a head opening;

an endless cord disposed in the cord channel; and a portion of the endless cord protruding from the UV-protective material in such a way that the cord is movable between a slack state and one of a plurality of tightened states successively decreasing a radius of the inner circumference, whereby successively folding the annulus substrate along each fold line symmetrically decreasing its footprint to one-eighth, and wherein the cord is dimensioned so that in a protrusion of the cord completely wraps around the outer periphery and the inner circumference, thereby securing the one-eighth footprint.

2. The headwear brim of claim 1, further comprising:

a cord lock operatively associating with said portion to move each tightened state between an unlocked condition and a locked condition.

3. The headwear brim of claim 1, wherein the plurality of fold lines comprises four equally spaced apart fold lines.

4. The headwear brim of claim 1, wherein the UV-protective material has a circumferentially spaced apart stitching pattern.

5. A method of increasing a sun-protection efficacy of a baseball cap, the method comprising:

donning the headwear brim of claim 1 over said baseball cap.

6. The method of claim 5, further comprising selectively adjusting the head opening by selectively urging the portion of the cord.

7. A headwear brim comprising:

an annulus substrate defining an inner circumference;

a plurality of fold lines integrated into and radially extending along the annulus substrate, wherein each fold line ends between the inner circumference an outer periphery of the annulus substrate;

a UV-protective material defining a cord channel along the inner circumference, and wherein the inner circumference defines a head opening, wherein the UV-protective material has a circumferentially spaced apart stitching pattern;

an endless cord disposed in the cord channel a portion of the endless cord protruding from the UV-protective material in such a way that the cord is movable between a slack state and one of a plurality of tightened states successively decreasing a radius of the inner circumference; and a cord lock operatively associating with said portion to move each tightened state between an unlocked condition and a locked condition, whereby successively folding the annulus substrate along each fold line symmetrically decreasing its footprint to one-eighth, wherein the cord is dimensioned so that in a protrusion of the cord completely wraps around the outer periphery and the inner circumference, thereby securing the one-eighth footprint.

* * * * *